US006225743B1

(12) United States Patent
Schwankhart

(10) Patent No.: US 6,225,743 B1
(45) Date of Patent: May 1, 2001

(54) METHOD FOR THE PRODUCTION OF PLASMA

(75) Inventor: Gerhard Schwankhart, Attnang-Puchheim (AT)

(73) Assignee: Inocon Technologie Gesellschaft m.b.H., Attnang-Puchheim (AT)

( * ) Notice: Subject to any disclaimer, the term of this patent is extended or adjusted under 35 U.S.C. 154(b) by 0 days.

(21) Appl. No.: 09/296,718

(22) Filed: Apr. 22, 1999

(30) Foreign Application Priority Data

May 4, 1998 (AT) ..... 285/98 U

(51) Int. Cl.[7] ..... H01J 7/24
(52) U.S. Cl. ..... 315/111.21; 219/121.48
(58) Field of Search ..... 315/111.21, 111.81, 315/111.91, 111.31; 118/723 R; 219/121.48

(56) References Cited

U.S. PATENT DOCUMENTS 4,839,492 * 6/1989 Bouchier ..... 219/121.48
4,974,487 * 12/1990 Goldstein et al. ..... 315/111.31
5,170,030 * 12/1992 Solley et al. ..... 219/121.48
5,901,551 * 5/1999 Butler ..... 219/121.48
5,924,278 * 7/1999 Burton ..... 219/121.48
6,037,562 * 3/2000 Awakowicz et al. ..... 219/121.48

* cited by examiner

*Primary Examiner*—Michael B Shingleton
(74) *Attorney, Agent, or Firm*—Collard & Roe, P.C.

(57) ABSTRACT

A device for supplying voltage to a plasma producer comprising a chamber having an outflow opening, and an anode and a cathode arranged in the chamber, the anode and cathode defining a gap therebetween, the voltage supplying device comprising a charging circuit, a capacitor battery having an input connected to the charging circuit and an output connected to the anode and the cathode, and an ignition set supplying HF signals connected to the anode and the cathode, a maximum voltage supplied by the capacitor battery being smaller than an arc-over voltage of the anode-to-cathode gap.

5 Claims, 2 Drawing Sheets

METHOD FOR THE PRODUCTION OF PLASMA

Figure 1:
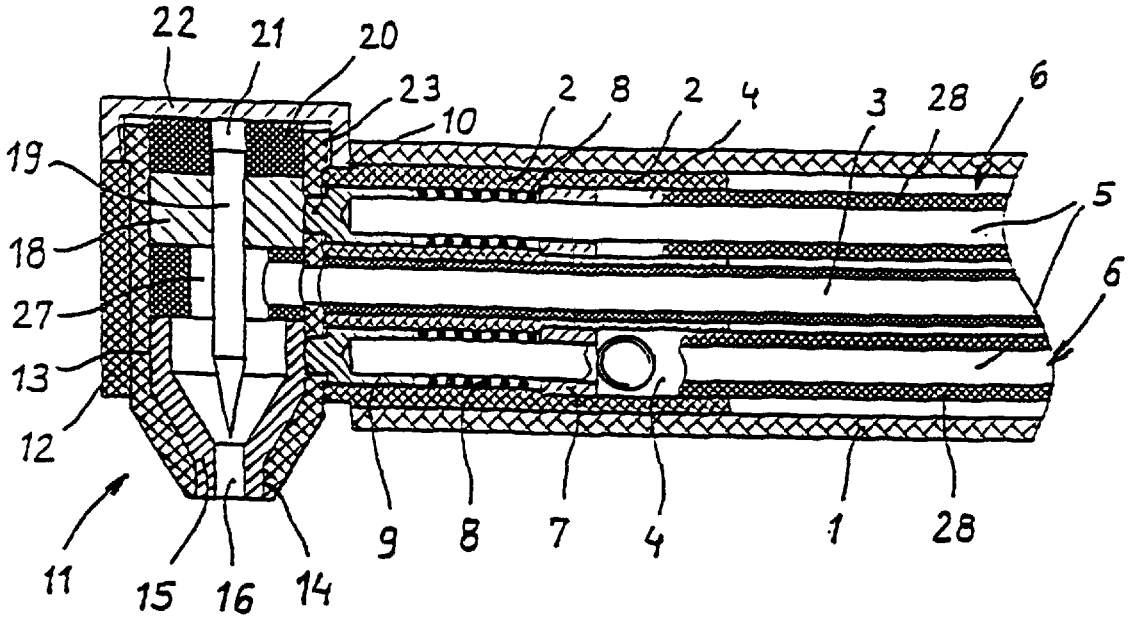

The invention relates to a device for supplying voltage to a plasma producer.

In a known device of this kind, a plasma gas is blown substantially continuously through a chamber in which the anode-to-cathode gap is located. A fluctuating current flow is ensured by way of the arc gap through a control of the power supply. Usually, the current will fluctuate with a frequency of 1 to 10 Hz, with the maximum current usually being 7 to 15 times the minimum current.

The power supply is usually formed by a transformer with downstream rectifier. Furthermore, in the known methods the anode-to-cathode gap is charged with a voltage corresponding to the arc drop voltage of the arc, with a separate ignition pulse being provided for igniting the arc.

The relevant aspect in the known method is that the arc will burn continuously, even though its output will fluctuate.

This is problematic for various applications due to its continuous energy output.

Thus, a plasma will emit UV radiation to a considerable extent which could be used for the sterilisation of objects, for example. However, the simultaneous radiation of a considerable quantity of heat constitutes a problem.

It is the object of the present invention to avoid such disadvantages and to provide a a device for supplying voltage to a plasma producer, in which.

The proposed measures will lead to the advantage that plasma pulses of only a very short duration can be produced. Such plasma pulses, despite their very high temperature, can be tolerated by even relatively sensitive materials without causing any damage as a result of their short duration because the energy introduced over a longer period into the material to be treated can be kept below a harmful level.

It is not absolutely necessary to introduce a gas in the anode-to-cathode path. Metal vapours emerging from the surface of the anode and cathode occur as a result of the temperature of the arc, which metal vapours are ionised by the arc and form a plasma which flows out of an outlet opening of a chamber receiving the anode and the cathode.

Holding the voltage pulses to $10^{-5}$ to $10^{-3}$ seconds, and preferably the pauses between the voltage pulses to 10 to 100 times the duration of the voltage pulses, allows keeping at a low level the energy introduced by a plasma produced in accordance with the invention into a subject charged with said plasma, so that even sensitive subjects can be processed with such a plasma whose individual pulses have a high energy density.

The invention accomplishes these objects with a device for supplying voltage to a plasma producer comprising a chamber having an outflow opening, and an anode and a cathode arranged in the chamber, the anode and cathode defining a gap therebetween, the voltage supplying device comprising a charging circuit, a capacitor battery having an input connected to the charging circuit and an output connected to the anode and the cathode, and an ignition set supplying HF signals connected to the anode and the cathode, a maximum voltage supplied by the capacitor battery being smaller than an arc-over voltage of the anode-to-cathode gap.

The proposed measures lead to a very simple arrangement, whereby the pulse times can be determined very easily by a dimensioning of the capacitors and the resistance of the circuit comprising the anode-to-cathode gap as well as the charging circuit for determining the respective time constants.

Since a very rapid heating of the medium disposed in the interior of the chamber will occur during the ignition of the arc, it will expand very rapidly and will flow outwardly with a high kinetic energy through the outlet opening. In the following interpulse period, air can flow into the cooling chamber from the ambient environment, so that the same can be operated in a practically regenerative manner and no gas flow that permanently flows through the chamber needs to be forced.

Since the individual plasma pulses exit with a high speed, there will not be any mixture with the ambient atmosphere during their emergence and thus there will not be any divergence of the plasma jet. In this context, tests have shown that the produced plasma pulses have a behaviour similar to that of globular lightning. This also ensures a very high energy density on the subject to be treated.

The HF ignition set allows a very precise determination of the ignition of the arc while ensuring that the end of the voltage pulse or the arc duration is determined by the discharge of the capacitor battery to a voltage below the arc drop voltage. This ensures even in the case of the ignition of the arc by means of a separate striking voltage source that the arc will extinguish between the individual pulses and no static current will flow through the anode-to-cathode gap.

The HF ignition set also allows triggering the ignition of the arc even before reaching the arc-over voltage of the anode-to-cathode gap, as a result of which the duration of the arc and thus the duration of the plasma pulse can be kept extremely short without having to make any special efforts to ensure a particularly low-impedance arrangement of the discharge circuit of the capacitor battery.

In principal, it also possible to use a technical A.C. system or a voltage source supplying a high-frequency alternating current in connection with a phase-angle control unit instead of the capacitor battery as a power supply means. In the case of electrodes made from different materials, it must be ensured that similarly polarised half-waves are partly connected through only so that voltage pulses with the same polarity are always applied to the different electrodes and substantially the same ratios as in the supply of the plasma torch with d.c. voltage pulses, like from a capacitor battery for example, are obtained.

In electrodes made from the same materials, pulses with different polarity can be applied to each of the two electrodes.

As electrodes which are made of different materials for the purpose of achieving a longer service life are usually charged with the same polarity in plasma torches, the anode and cathode are referred to generally in the description and the claims.

In order to ensure the short pulses which are provided for according to the method of the invention, it will usually be appropriate to provide a through connection by means of the phase-angle control only in the falling branch of the respective half-wave, which also depends on the rigidity of the supplying voltage source. It can also be provided to block the phase-angle control after each through connection for a certain number of periods in order to reduce the repeat frequency of the plasma pulses to a desired level.

Preferably, the diameter of the outflow opening of the plasma producer is 10 $\mu$m to 100 $\mu$m. This has the advantage that the individual plasma pulses exit from the outlet opening of the chamber with a very high speed and impinge on the subject to be treated with a very high kinetic energy. Outgoing speeds of 1000 to 2000 m per second could be determined in experimental set-ups. In this way it is possible to manufacture very small bores in thin sheet metal or even weld points.

The application of a plasma produced in accordance with the invention is also provided in accordance with the invention for sterilising objects, in particular interior spaces of hollow objects or conduits.

In this process, any bacteria or viruses are killed rapidly and effectively, despite the short exposure time, by the high temperature of the individual plasma pulses, which are approx. 20,000 to 50,000° C., and are simultaneously removed from the surface of the object to be sterilised by the kinetic energy of the plasma pulses so that no "bacteria carcasses" remain.

As a result of the continued production of very short plasma pulses as provided for in accordance with the invention, they can also be used for surgical and dental purposes, e.g. instead of laser scalpels.

Plasma torches with a relatively small output, e.g. from 0.5 kW to 10 kW, can be used in both cases.

Furthermore, the plasma produced in accordance with the invention can also be used very favourably for spot welding or the production of seams made of weld spots.

A behaviour similar to that of flow plasma can be obtained in the production of plasma pulses with a frequency of approx. 7 Hz without causing any relevant withdrawal of energy from the plasma jet as a result of the mixture of the border zones of the plasma jet with the ambient atmosphere, which would lead to an undesirable heating of the ambient environment and to an undesirable heating of the subject outside of the actual area of machining.

As a result, considerably less energy as compared with the previously used flow plasma is required for welding with a plasma produced in accordance with the invention. Moreover, there is an overall lower heating of the subject and thus also lower thermal stresses and deformations of the subject. Furthermore, the solidification of the individual weld points occurs more rapidly than when welding with flow plasma as a result of the very small melting bath volumes. This allows achieving a favourable welding quality in every welding position, i.e. even in overhead positions.

It is understood that the plasma torches required for the production of the plasma pulses must have a respective output, e.g. 20 kW up to 150 kW and more, depending on the parts to be welded. A spot weld of thin sheet can be produced with merely one plasma pulse with a short duration of only $10^{-3}$ to $10^{-5}$ seconds for example.

Figure 2:
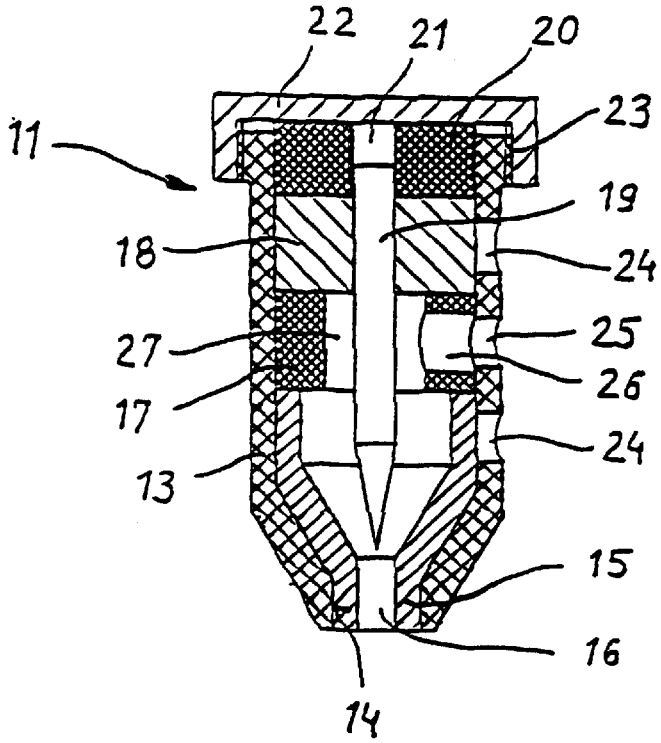
Figure 3:
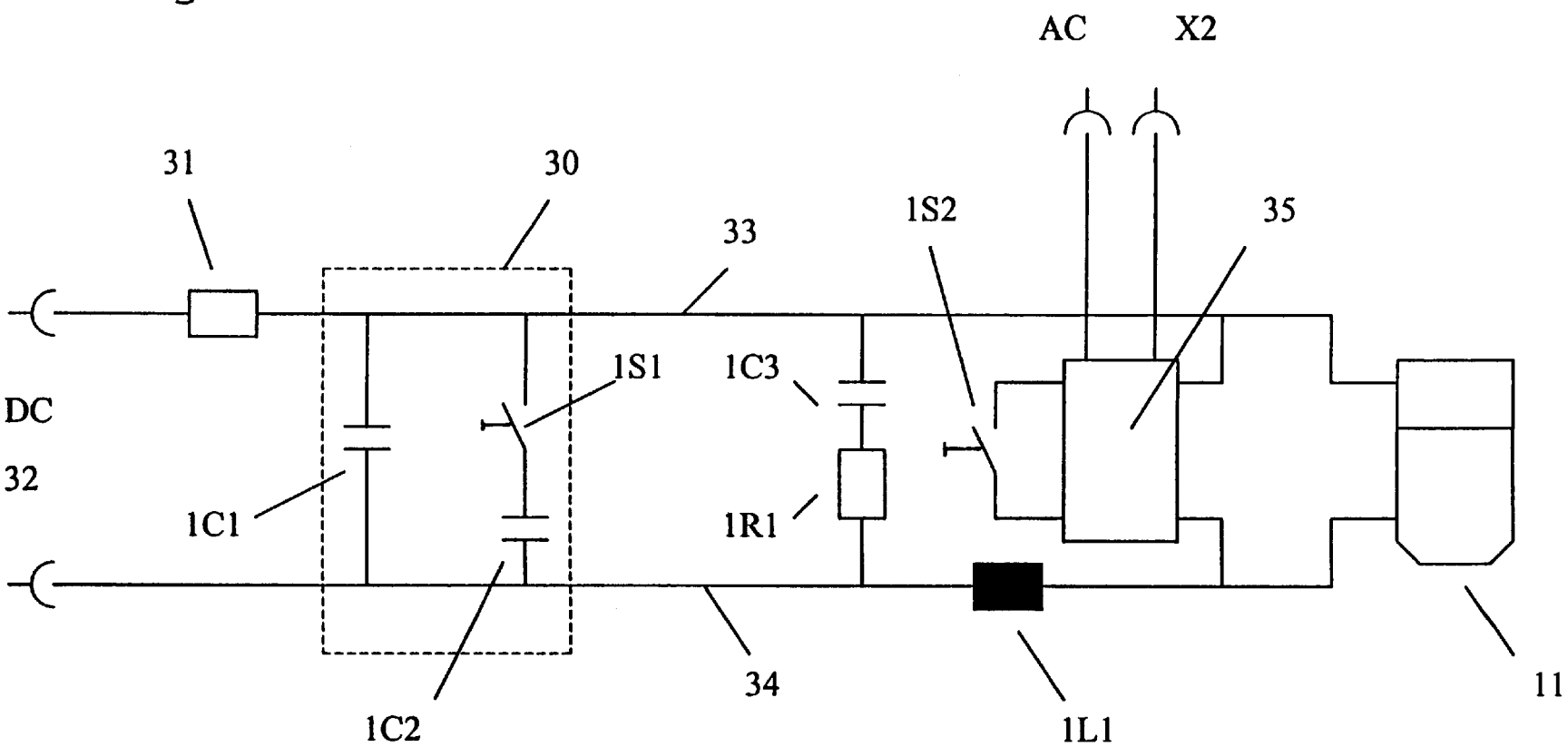

The invention is now explained in closer detail by reference to the accompanying drawing, wherein:

FIG. 1 schematically shows a sectional view through a holder with an inserted plasma producer;

FIG. 2 schematically shows a sectional view on an enlarged scale through a plasma producer in accordance with FIG. 1;

FIG. 3 schematically shows the electric circuit of a device in accordance with the invention.

In the embodiment in accordance with FIGS. 1 and 2 a holder 1 is provided which is made from an electrically insulating material such as ceramic, is substantially hollow-cylindrical and where an insert 2, which is also made of an insulating material, is pressed into one of its end zones.

Said insert 2 is penetrated by a central tube forming a gas supply line 3 and ending at the face side of the insert 2 projecting over the face side of holder 1. Insert 2 is further provided with two bores 4 which are disposed in a diametrical plane and in which press-fit parts 7 are held which are used as abutments and are penetrated by the cores 5 of connecting lines 6 with play.

These connecting lines 6 are connected with a voltage supply which is shown in FIG. 3 and supplies voltage pulses at a predetermined frequency.

Pressure springs 8 rest on said press-fit parts 7 and press outwardly the contact pins 9 which are soldered together with the cores 5. Contact pins 9 are provided at their free end with a face-sided nose 10 which co-operates with a contact surface of a plasma producer 11 which is held in a fastening device 12 which is arranged on the face side of holder 1, said fastening device 12 is formed as a clip made from an electrically insulating material and in which the plasma producer 11 is inserted from above.

Said plasma producer 11 is provided with a connecting element 13 which is made from an electrically insulating material such as ceramic, is arranged in its lower zone in a conically tapering manner and is provided at its lower face side with an opening 14.

Said opening 14 is penetrated by an annular anode 15 which in the usual way is made from an electrically conducting and thermally heavy-duty material and is provided in its orifice zone with a nozzle opening 16.

Anode 15 is provided with an upwardly conically expanding region which rests inwardly on the connecting part 13 and verges into a cylindrical zone.

An intermediate part 17 rests on the upper face side of anode 15 which is provided with an annular shape and is made from an electrically insulating material such as ceramic.

A holding part 18, which is made of an electrically well-conducting material such as copper, rests on the upper face side of the intermediate part 17. A cathode 19 is pressed into said holding part which is made from an electrically conducting and thermally highly resistant material such as a tungsten-cerium oxide alloy and is provided in its end zone close to the nozzle opening 16 of anode 15 with a conical arrangement.

Anode 15 as well as the holding part 18 are appropriately pressed into the connecting part 13 for the purpose of determining the mutual position of the cathode 10 and the nozzle opening 16 of the anode.

The anode 15, the intermediate part 17 and the holding part 18 with the pressed-in cathode 19 form jointly with the connecting part 13, a module of the device which can easily be built into the holder and can be removed again from the same.

A pressure part 20 made of an insulating material rests on the upper face side of the holding part 18, which pressure part is provided with a bore 21 for receiving the cathode 19 with play and projects beyond the face side of the connecting part 13.

Said pressure part 20 co-operates with a lid 22 which is screwed onto an outside thread 23 arranged in a zone close to the upper face side of the connecting part 13.

The connecting part 13 is provided with three radial bores 24, 25 which are arranged along a surface line, of which bores 24 allow the passage of the noses 10 of the contact pins 9 and lie in the zone of the holding part 18 or anode 15. Bore 25 is arranged in the zone of the intermediate part 17 and is flush with a radially extending inlet 26 of the intermediate part which leads to chamber 27 which is limited by the inner wall of the intermediate part 17 and is penetrated by the cathode 19.

When the plasma producer, which is arranged as a module, is inserted in the holder 1, the bore 25 is also flush with the gas supply line 3 provided in the holder 1.

For installing the plasma producer 11 which is arranged as a module, it is sufficient to withdraw the connecting lines 6 whose insulating sheaths 28 are guided with play in the bores 4 of the insert 2 of the holder 1 and to insert the plasma producer 11 from above in clip 12. Thereafter one can release the connecting lines 6 and the contact pins 9 will snap into the bores 24 of the connecting part 13 and will secure the position of the plasma producer 11 in the holder 1. At the same time they are pressed with their face sides against the holding part 8 or anode 15 by means of springs 8 and thus a favourable electric contact is produced.

During the operation of the plasma producer 11, a gas such as helium, $CO_2$ and the like can be introduced through the gas supply line 3 into the chamber 27 which is also limited, among other things, by an anode 15 defining a nozzle opening 16, which gas flows around cathode 19 and simultaneously cools the same in operation.

If a voltage pulse is applied whose voltage is over the arc-over voltage of the gap between anode 15 and cathode 19, an arc will be formed which produces a plasma that emerges from the nozzle opening 16 and can be used for producing a weld seam or for cutting materials for example. If the voltage applied to cathode 19 and anode 15 drops below the arc drop voltage, the same will go out and the current flow over the anode-to-cathode gap will be interrupted.

Notice should be taken principally that an introduction of gas into chamber 27 is not ultimately necessary and that the same also need not have any bore 25. In such a case the chamber 27, after the ejection of the plasma pulse, will suck in air from the ambient environment after the arc goes out. During the following ignition of a new arc, as a result of applying a further voltage pulse, the air is ionised by the arc and rapidly heated, as a result of which it expands in a respectively rapid manner and flows out from the nozzle opening 16 with a high speed.

A voltage supply for a plasma producer according to FIGS. 1 and 2 is shown in FIG. 3.

A capacitor battery 30 is connected by way of a charging resistor 31 with the connections X1 of a controllable DC voltage source 32. The capacitor battery 30 is provided with a fixedly connected capacitor 1C1 and a capacitor 1C2 which can be connected in parallel with the same through a switch 1S1. Groups of capacitors can be concerned in both cases.

This capacitor battery 30 is connected by way of connecting lines 33, 34 with the cathode and anode, of plasma producer 11.

An RC module is switched in parallel to the capacitor battery 30 which is formed by a capacitor 1C3 and a resistor 1R1. This RC module forms a rejection circuit in conjunction with a choke 1L1 switched in the connecting line 34, which choke is provided for the protection of the capacitor battery 30 against HF signals.

The outputs of an ignition set 35 are further connected to the connecting lines 33, 34. Said ignition set 35 is connected on the input side with an AC voltage source X2 and provided with a trigger switch 1S2 by which an ignition pulse can be initiated when actuated.

During operation, the capacitor batteries 30 are charged according to the set voltage of the DC voltage source 32 which is adjustable between 50V and 300V and the time constant which is co-determined by the line resistances and the charging resistance.

Once the capacitor battery reaches a voltage which corresponds to the arc-over voltage of the anode-to-cathode gap 15, 19 of the plasma producer 11, an ignition of an arc between anode 15 and cathode 19 (FIG. 2) and thus the formation of plasma in chamber 27 of the plasma producer 11 will occur.

At the same time the capacitor battery 30 will discharge according to the time constant given by its capacity, the line resistances and the resistance of the arc. If as a result of this discharge the voltage of the capacitor battery 30 drops below the arc drop voltage, the same goes out and the capacitor battery 30 charges up again, as a result of which the described process is repeated and a frequency is obtained which is determined by the charging and discharging time constants. The operation of the ignition set is not required.

For certain applications it can be desirable to determine the ignition time of the arc precisely or to initiate such a one prior to reaching the arc-over voltage of the anode-to-cathode gap.

In this case an ignition pulse is initiated by actuating the trigger switch 1S2 which leads to the ignition of an arc between the anode 15 and the cathode 19 of the plasma producer 11 without the capacitor battery having reached a voltage corresponding to the arc-over voltage of this gap. In this way the pulse-duty factor, which can be selected between 1:10 and 1:100 and even beyond this figure, can be changed respectively and the ratio between the arc duration and its pause during a cycle can be changed in the sense of an extension of the arc pause, since the energy of the high-frequency ignition pulses of the ignition set is sufficient for igniting the arc, but not for maintaining the same when the voltage of the capacitor battery drops below the arc drop voltage.

What is claimed is:

1. A device for supplying voltage to a plasma producer comprising a chamber having an outflow opening, and an anode and a cathode arranged in the chamber, the anode and cathode defining a gap therebetween, the voltage supplying device comprising (a) a charging circuit, (b) a capacitor battery having an input connected to the charging circuit and an output connected to the anode and the cathode, and (c) an ignition set supplying HF signals connected to the anode and the cathode, a maximum voltage supplied by the capacitor battery being smaller than an arc-over voltage of the anode-to-cathode gap.

2. A device as claimed in claim 1, wherein the diameter of the outflow opening (16) of the plasma producer (11) is 10 $\mu$m to 100 $\mu$m.

3. An application of the device as claimed in claim 1 for sterilising objects, in particular interior spaces of hollow objects or conduits.

4. An application of the device as claimed in claim 1 for surgical or dental purposes.

5. An application of the device as claimed in claim 1 for spot welding.

* * * * *